United States Patent [19]

Peickert et al.

[11] 4,219,007

[45] Aug. 26, 1980

[54] COMBINATION HEARTH AND FIREWALL

[76] Inventors: Stanley A. Peickert; Robert C. Peickert, both of P.O. Box 452, The Dalles, Oreg. 97058

[21] Appl. No.: 907,161

[22] Filed: May 18, 1978

[51] Int. Cl.[3] ..... F24C 15/08

[52] U.S. Cl. ..... 126/279

[58] Field of Search ..... 126/277, 305, 55, 130, 126/131, 6, 121, 279, 278

[56] References Cited

U.S. PATENT DOCUMENTS

| | | | |
|---|---|---|---|
| 105,773 | 7/1870 | Brownell | 126/279 |
| 141,106 | 7/1873 | Bingham et al. | 126/279 |
| 189,470 | 4/1877 | Jones | 126/279 |
| 374,235 | 12/1887 | Bassett | 126/279 |
| 2,535,528 | 12/1950 | Brodbeck | 126/305 |
| 3,190,282 | 6/1965 | Bauer | 126/131 |
| 4,008,705 | 2/1977 | Robertson | 126/121 |

*Primary Examiner*—Carroll B. Dority, Jr.
*Assistant Examiner*—Wesley S. Ratliff, Jr.
*Attorney, Agent, or Firm*—Eugene M. Eckelman

[57] ABSTRACT

A hearth-like base portion has a top stove supporting wall spaced above the supporting surface to provide an insulating area below the stove. Also, an upright firewall portion is secured to the rearward end of the base portion and has a face plate arranged to be spaced from the wall of a room to provide an insulating area behind the stove. Air circulation passageways are provided in the base and firewall portions for cooling. The discharge of heat from these portions may be upward by convection or in a reverse direction by a powered blower. A removable mantle is supported on the top of the firewall portion.

8 Claims, 11 Drawing Figures

COMBINATION HEARTH AND FIREWALL

BACKGROUND OF THE INVENTION

This invention relates to a novel combination hearth and firewall structure arranged for use with stoves and the like.

In view of environmental considerations, free standing fireplaces such as wood or coal stoves are again gaining popularity. Many installations of these stoves create fire hazards since too much heat radiates from the stove toward the floor and toward the room walls. In view of the increased popularity of stoves, more regulations as to their construction and installtion are being put into force. Many of such installations cannot be accomplished without special construction such as firewalls and floor sections. These special constructions are generally expensive, and in addition to detracting from the room decor most of the heat absorbed in them is lost. Also, these constructions are impractical in older existing houses.

SUMMARY OF THE INVENTION

According to the present invention and forming a primary objective thereof, a combination hearth and firewall structure is provided which is attractive in appearance, which protects the floor and wall of a room from the heat of a stove, and which has a structure facilitating transfer of absorbed heat into the room.

The objectives of the invention are carried out by a structure employing a hearth-like base portion and a firewall portion each of which forms air insulating areas so as to protect the floor and wall from excessive heat. The base and firewall portions also include air circulation means whereby heated air can circulate up by convection or in any desired direction by powered blower means. The base and firewall portions are disconnectable for convenience in handling, shipping and storage and can be constructed to fit adjacent one wall of a room or in a corner.

The invention will be better understood and additional objects and advantages will become apparent from the following description taken in connection with the accompanying drawings.

DETAILED DESCRIPTION OF PREFERRED EMBODIMENTS

Figure 8:
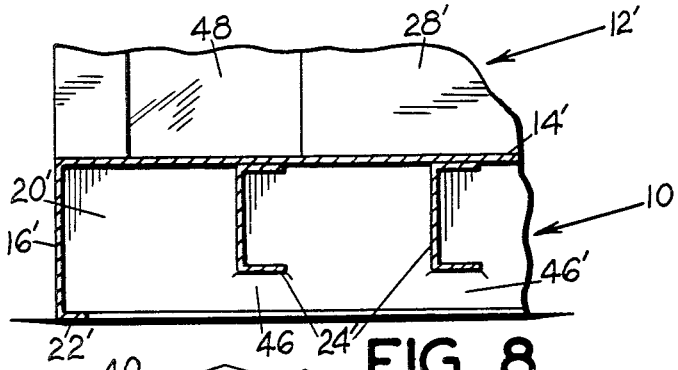
FIG. 8 is a fragmentary sectional view taken on the line 8—8 of FIG. 6.

With particular reference to the drawings and first to the embodiment of FIGS. 1-4, the invention comprises generally a base portion 10 arranged to be supported on the floor of a room and a firewall portion 12 standing upright on the base portion 10. Base portion 10 comprises a plate-like top wall 14 having integral side walls 16, a front wall 18, and rear wall 20, the bottom edges of the walls 16, 18 and 20 having an inturned flange portion 22 to increase the structural strength and also to form a foot for seating on the floor. The bottom area between the flanges 22 is open. By means of the structure described, an air insulating area is provided below the plate 14 to prevent the floor from becoming overheated.

Wall portions 16, 18 and 20 provide support for the top wall 14 on the floor. Reinforcing channel bars 24 are secured to the bottom of wall 14 to increase the structural strength of the base and to provide additional support for such wall on the floor. The front corners 26 of the base are angled to provide an attractive appearance and to eliminate sharp corners.

Firewall portion 12 has a front plate 28 with integral rearwardly extending side walls 29 having inwardly turned reinforcing flange portions 30 at the rear. The rear area between the flange portions 30 is open. Firewall portion 12 has rearwardly turned top and bottom walls 31 and 32, respectively, also provided with inwardly turned reinforced flanges 30. Extending integrally in a rearward direction from the plate 28 are a plurality of Z-bars 34 which support a baffle plate 36 in spaced relation from the plate 28. This baffle plate is located in the area which will receive the greatest heat. by means of the firewall structure described, an air insulating area is provided behind the plate 28 to prevent the wall from becoming overheated. In addition, baffle plate 36 provides extra heat deflection and heat absorption in an area where the most heat will be concentrated.

The hearth portion 10 and firewall portion 12 may be used apart from one another where situations require such an arrangement. If used in connected form as shown, the connection is made by screws 38 passing through bottom wall 32 of firewall portion 12 and threadedly engaging the top wall 14 of hearth portion 14. The two main parts 10 and 12 can be shipped, stored and handled separately, however, and secured together at the site of use. The upper end of the firewall portion may if desired support a cap 40 having downwardly depending front and rear walls 42 which provide a depth appearance so as to simulate a mantle. The rear wall of the cap fits down behind the flanges 30 and the front wall thereof has an inturned flange portion 44 to abut up against the front of plate 28 and stabilize the mantle.

Each of the side walls 16 and 29 is provided with vent holes 45.

Figure 1:
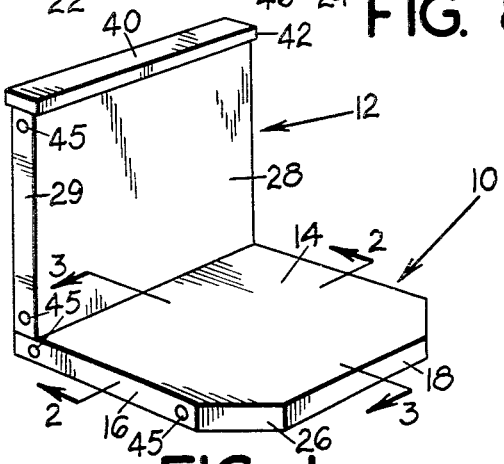
FIG. 1 is a perspective view of a first form of combination hearth and firewall structure embodying principles of the instant invention.
Figure 7:
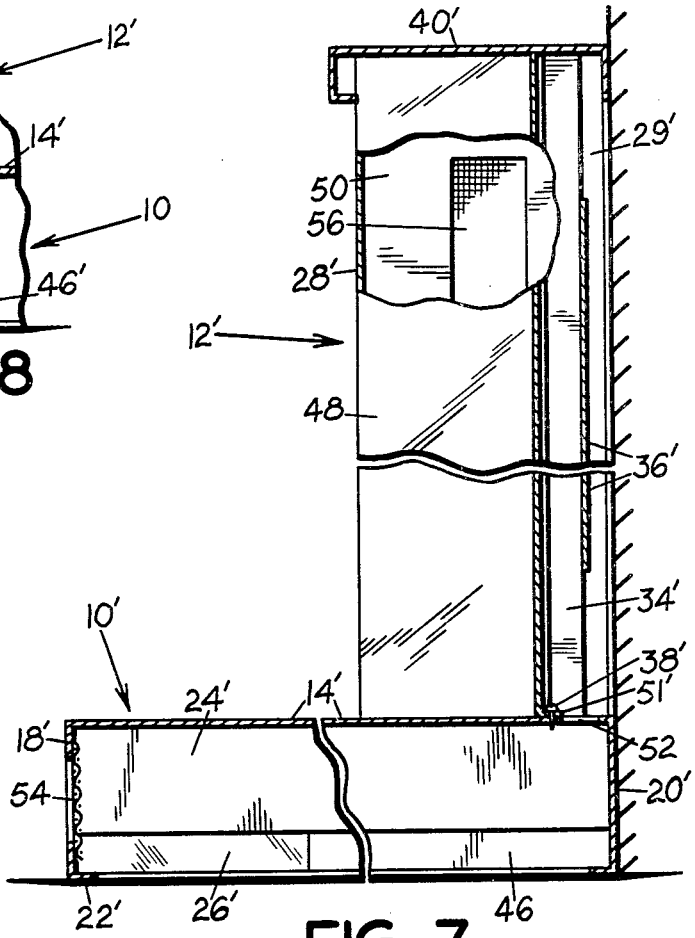
FIG. 7 is a foreshortened sectional view taken on the line 7—7 of FIG. 6.
Figure 2:
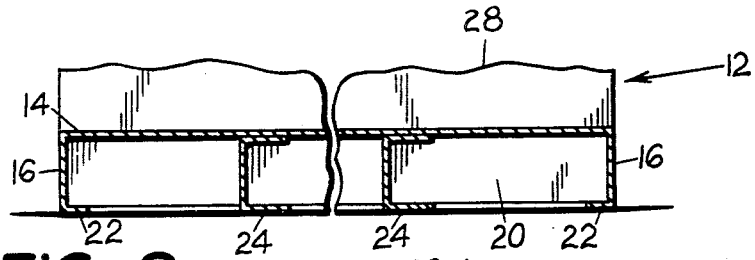
FIG. 2 is an enlarged foreshortened fragmentary sectional view taken on the line 2—2 of FIG. 1.
Figure 3:
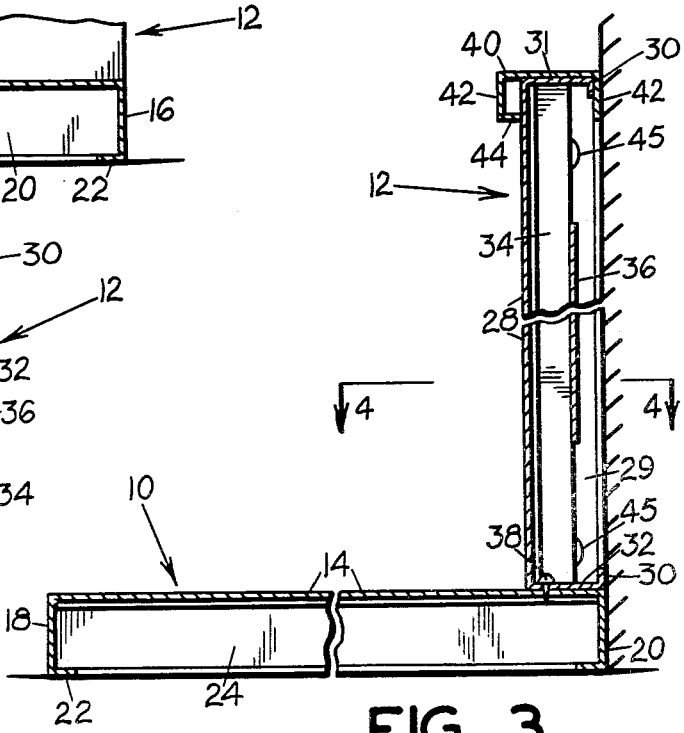
FIG. 3 is an enlarged foreshortened sectional view taken on the line 3—3 of FIG. 1.
Figure 4:
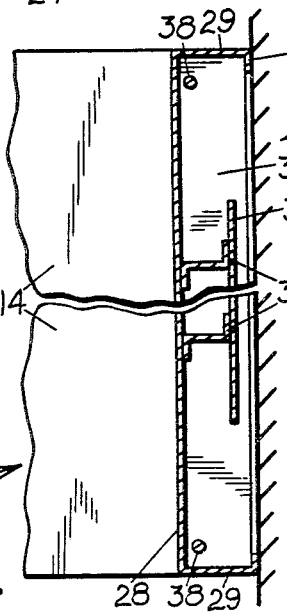
FIG. 4 is a foreshortened fragmentary sectional view taken on the line 4—4 of FIG. 3.

With particular reference now to FIGS. 5–8, structure is shown which is similar to that of FIG. 1 comprising a base portion 10′ and a firewall portion 12′, the base portion 10′ having a top plate 14′, side walls 16′, a front wall 18′ and a rear wall 20′. Walls 16′, 18′ and 20′ have an inturned flange 22′ at the bottom thereof. The top plate 14′ has reinforcing channels 24′ secured to its undersurface. The supporting walls 16′ 18′ and 20′ in this structure have a greater height than the channel bars 24′, however, whereby to provide a space 46 under such bars for lateral circulation of air.

In this embodiment, the firewall portion 12′ also includes a front plate 28′ and a rear baffle plate 36′ supported by Z-bars 34′. In this embodiment, however, the front plate 28′ has forwardly angled portions 48 on each side to form enlarged air spaces 50 at the sides. The angled disposition of wall portions 48 increases the area of protection that is accomplished by the firewall portion by forming a pocket in which a rear portion of a stove will be received. Firewall portion 12′ has a bottom rearwardly extending flange 51′ providing connection by screws 38′ onto the hearth portion 14′.

Apertures 52 are provided in the top plate 14′ in areas 50 and the area therebetween and such apertures establish communication between the area behind plate 28′ and the area below top plate 14′, whereby air can circulate between the base and firewall portions. The spaces 46 below the channel bars 24′ allow air to circulate through the full width of the base portion. The front wall 18′ of the base portion 10′ is provided with a mesh covered opening 54, and each side 29′ of the firewall portion adjacent an upper portion thereof is provided with an upper enlarged opening 56, whereby natural flow of air currents by convection can move through the base and firewall portions and increase the cooling efficiency of the present invention. The firewall portion has screw connection to the hearth portion as in the first embodiment and similarly has a cap 40′ simulating a mantle.

Figure 9:
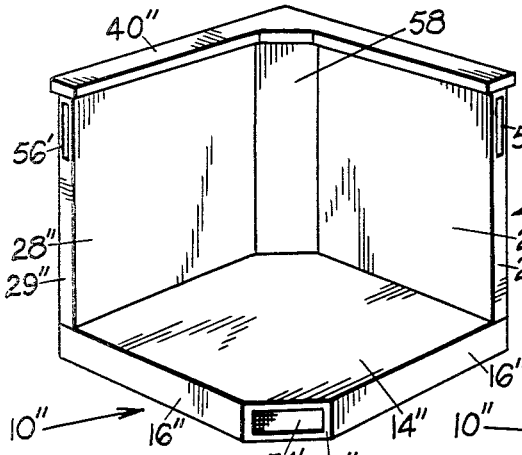
FIG. 9 is a perspective view of still another form of combination hearth and firewall structure embodying principles of the instant invention.
Figure 10:
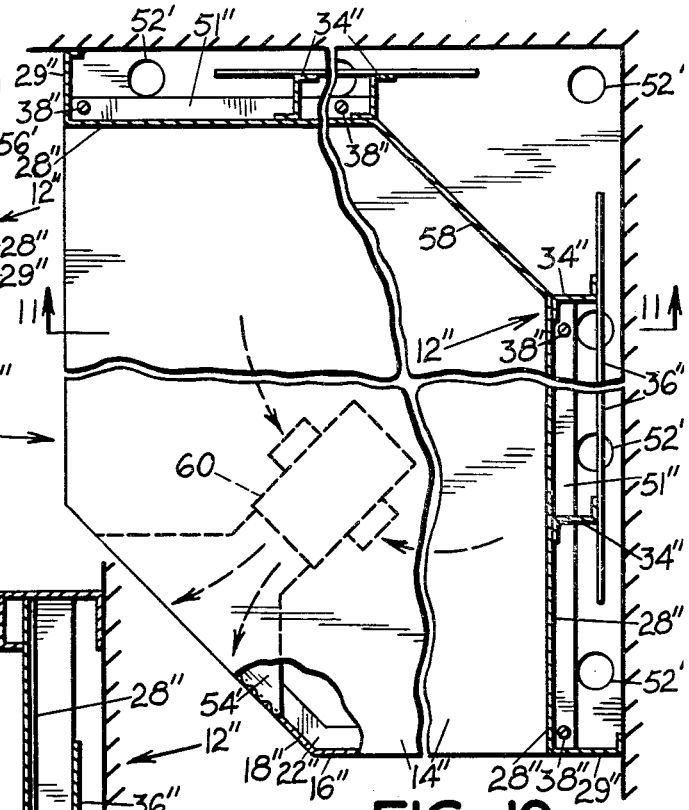
FIG. 10 is a foreshortened top plan view of the embodiment of FIG. 9, a mantle portion of this structure being removed for clarity.
Figure 11:
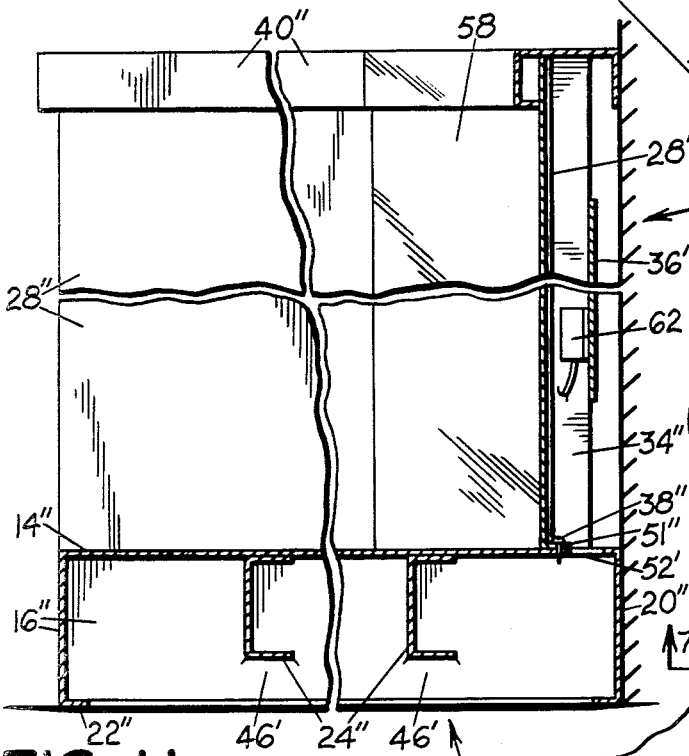
FIG. 11 is a foreshortened sectional view taken on the line 11—11 of FIG. 10.
Figure 5:
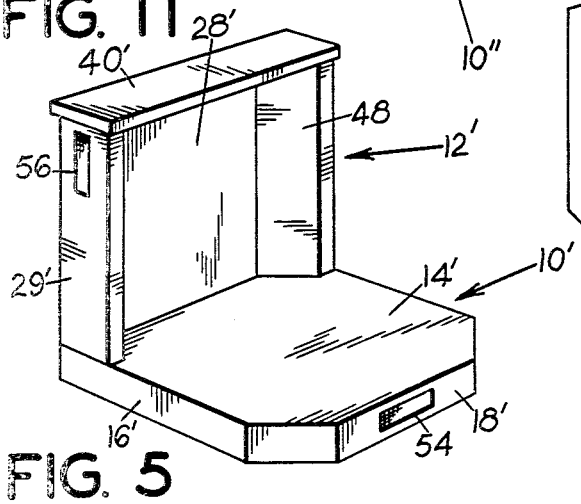
FIG. 5 is a perspective view of a second form of combination hearth and firewall structure embodying principles of the instant invention.
Figure 6:
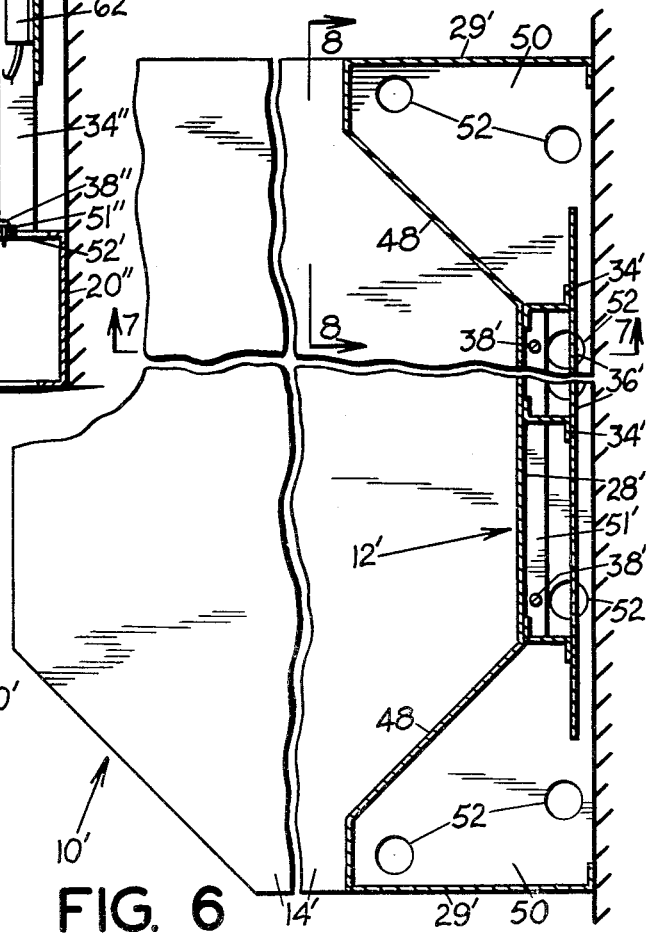
FIG. 6 is an enlarged foreshortened top plan view of the embodiment of FIG. 5, a mantle portion of this structure being removed for clarity.

With reference to the embodiment of FIGS. 9–11, the base portion 10″ is different in that its top plate 14″ has right angle rear wall portions 20″ arranged to fit in the corner of a room. This hearth portion also has side wall portions 16″ and a front wall portion 18″ as well as elevated reinforcing channel bars 24″ as in FIGS. 5–8.

Firewall portion 12″ of FIGS. 9–11 has a pair of front plates 28″ disposed at right angles to each other and connected by an oblique center portion 58. A baffle plate 36″ is supported behind each of the respective portions 28″ by Z-bars 34″, and apertures 52′ are provided in the rear of the top plate 14″ to allow circulation between the base and firewall portions. A mesh covered front opening 54′ is provided in the front wall 18″ and openings 56′ are provided in the sides 29″ of the firewall portion. In this embodiment, a blower 60 is mounted on the underside of the plate 14″ and is arranged to provide forced circulation of air preferably in a reverse direction from the natural flow of convection currents. Thus, with the operation of the blower 60, room air will be drawn in through the openings 56′ and heated air will be discharged through opening 54′ at floor level, thus forcing heated air into the room. This blower could as well be applied to the embodiment of FIGS. 5–8. Heat sensing and control means 62 such as a thermostat is mounted on one or both of the baffles 36″ and is in circuit with the blower 60 for controlling the operation of the latter, thus automatically controlling the temperature at which the blower will operate and also preventing any overheated conditions.

Plate portions 28″ have rearwardly turned flanges 51″ for disconnectable screw connection 38″ to the base portion and also have a suitably shaped removable mantle cap 40″ supported thereon.

According to the present invention, a combination hearth and firewall structure is provided which efficiently insulates the stove from the floor and wall. The structure can thus be seated directly on the floor and directly up against a wall. The assembled structure is attractive in appearance and adds to substantially any room decor. The base portion simulates a raised hearth and the firewall portion simulates a fireplace-defining structure with a mantle. The principle parts of the base and firewall portions are preferably metal whereby to absorb heat and to efficiently allow it to be carried into the room by convection or by forced air means. The protective functioning of the invention will allow installations of stoves in existing homes and at the same time satisfy stringent fire codes.

It is to be understood that the forms of our invention herein shown and described are to be taken as preferred examples of the same and that various other changes in the shape, size and arrangement of parts may be resorted to without departing from the spirit of my invention or the scope of the subjoined claims.

Having thus described my invention, I claim:

1. A combination hearth and firewall structure arranged to add to the attractiveness of a room and also to insulate a stove from the floor and room walls, said structure comprising (a) a base portion arranged to be seated on the floor and having front and rearward ends, (b) said base portion including a top wall for supporting a stove and also including downwardly extending support means including side walls for supporting said top wall above the floor forming an insulating air space under said top wall, said side walls including an air opening in the forward portion of said base portion and said top wall having an air opening at its rear, (c) an upright firewall portion supported on said base portion, (d) said firewall portion including a front wall and rearwardly extending side walls forming an insulating air space between said front wall and a room wall and said firewall portion having an air outlet opening in its upper extremity, (e) means attaching said firewall portion in its upright supported position on said base portion adjacent to the rearward end of said base portion, (f) said air openings in said side walls and firewall, portion being in communication for forming a continuous flow path for cooling air extending through both the base portion and said firewall portion.

2. The combination hearth and firewall structure of claim 1 including spaced elongated reinforcing members secured to the underside of said top wall, said reinforcing members terminating short of the floor to provide circulation of air thereunder.

3. The combination hearth and firewall structure of claim 1 including forced air means arranged to circulate air through said base portion and firewall portion.

4. The combination hearth and firewall structure of claim 1 wherein the rearward end of said base portion is shaped to fit in a corner of a room.

5. The combination hearth and firewall structure of claim 1 wherein said firewall portion includes forward extensions at each side of said base portion, said extensions communicating with said insulating air spaces in both of said base portion and firewall portion for receiving insulating air circulation.

6. The combination hearth and firewall structure of claim 1 including a baffle secured to the rear of said front wall in spaced parallel relation therewith and in an area of greatest heat from a stove on said base portion, said baffle being of less width than said firewall portion to allow circulation of air around its ends.

7. A combination hearth and firewall structure arranged to add to the attractiveness of a room and also to insulate a stove from the floor and room walls, said structure comprising (a) a base portion arranged to be seated on the floor and having front and rearward ends, (b) said base portion including a top wall for supporting a stove and also including downwardly extending support means supporting said top wall above the floor forming an insulating air space under said top wall, (c) an upright firewall portion, (d) said firewall portion including a front wall and rearwardly extending side walls forming an insulating air space between said front wall and a room wall, (e) a baffle secured to the rear of said front wall in spaced relation and in an area of greatest heat from a stove on said base portion, (f) electrically operated forced air circulating means arranged to circulate air through said insulating air spaces, (g) and heat sensing means adjacent said baffle controlling the operation of said forced air circulating means.

8. A combination hearth and firewall structure arranged to add to the attractiveness of a room and also to insulate a stove from the floor and room walls, said structure comprising (a) a base portion arranged to be seated on the floor and having front and rearward ends, (b) said base portion including a top wall for supporting a stove and also including downwardly extending support means including side walls for supporting said top wall above the floor forming and insulating air space under said top wall, side walls including an air opening in the forward portion of said base portion and said top wall having an air opening at its rear, (c) an upright firewall portion, (d) said firewall portion including a front wall and rearwardly extending side walls forming an insulating air space between said front wall and a room wall and said firewall portion having an air outlet opening in its upper extremity, (e) a baffle secured to the rear of said front wall in spaced relation and in an area of greatest heat from a stove on said base portion, (f) said baffle being of less width than said firewall portion to allow circulation of air around its ends, (g) said air openings in said side walls of said support means, top wall and firewall portion being in communication for forming a continuous flow path for cooling air extending through both the base portion and said firewall portion.

* * * * *